US007658174B2

(12) United States Patent
Stoller

(10) Patent No.: US 7,658,174 B2
(45) Date of Patent: Feb. 9, 2010

(54) METHOD FOR CONTROLLING GLOW PLUGS IN DIESEL ENGINES

(76) Inventor: Bernd Stoller, Pfarrstrasse 61, Fellbach (DE) D-70734

( * ) Notice: Subject to any disclaimer, the term of this patent is extended or adjusted under 35 U.S.C. 154(b) by 0 days.

(21) Appl. No.: 11/793,069

(22) PCT Filed: Sep. 16, 2006

(86) PCT No.: PCT/EP2006/009034

§ 371 (c)(1),
(2), (4) Date: Jun. 15, 2007

(87) PCT Pub. No.: WO2007/031341

PCT Pub. Date: Mar. 22, 2007

(65) Prior Publication Data

US 2008/0210186 A1 Sep. 4, 2008

(30) Foreign Application Priority Data

Sep. 16, 2005 (DE) ..... 10 2005 044 359

(51) Int. Cl.
*F02N 17/02* (2006.01)
*F02P 19/02* (2006.01)

(52) U.S. Cl. ..... 123/145 A; 123/179.6; 701/113; 219/270

(58) Field of Classification Search ..... 701/102, 701/105, 113; 123/143 R, 145 A, 179.6; 219/270, 492, 494, 497
See application file for complete search history.

(56) References Cited

U.S. PATENT DOCUMENTS 4,478,181 A 10/1984 Kikuchi et al.
5,241,929 A * 9/1993 Grassi et al. ..... 123/145 A
5,327,870 A * 7/1994 Boisvert et al. ..... 123/145 A
6,009,369 A * 12/1999 Boisvert et al. ..... 701/99
6,148,258 A * 11/2000 Boisvert et al. ..... 701/99
6,164,258 A * 12/2000 Petrovich et al. ..... 123/179.6
6,283,092 B1 * 9/2001 Jung ..... 123/339.15
6,637,392 B2 * 10/2003 Jung ..... 123/145 A
7,188,597 B2 * 3/2007 Rodriguez et al. ..... 123/179.6
7,252,062 B2 * 8/2007 Hiramatsu ..... 123/142.5 E
7,500,457 B2 * 3/2009 Hiramatsu ..... 123/145 A
2006/0207541 A1 9/2006 Hiramatsu
2006/0289425 A1 12/2006 Serra et al.

OTHER PUBLICATIONS

"The New Elctronically Controlled Glow System ISS for Diesel Engines," MTZ Motortechnische Zeitschrift, Apr. 10, 2000, 2-8, vol. 61, Germany.

* cited by examiner

*Primary Examiner*—Stephen K Cronin
*Assistant Examiner*—Johnny H Hoang

(57) ABSTRACT

The invention describes a method for controlling glow plugs in diesel engines by varying the effective electric voltage applied to the glow plugs between an initial value and a target value, which is obtained at the end of a cold start phase determined by an engine control unit and which is smaller than the initial value, wherein the increase in voltage, i.e. the voltage difference by which the effective voltage applied to the glow plugs in the cold start phase is higher than its target value, is reduced by steps from a maximum value to zero. The invention provides that the effective electric voltage is increased in the cold start phase of the engine over a predetermined period or time, which is determined by the time elapsed until a preselected number of revolutions of the engine is reached.

20 Claims, 1 Drawing Sheet

METHOD FOR CONTROLLING GLOW PLUGS IN DIESEL ENGINES

The present invention relates to a method having the features defined in the preamble of Claim 1. A method of this kind has been known from the paper entitled "Das elektronisch gesteuerte Glühsystem ISS für Dieselmotoren", published in DE-Z MTZ Motortechnische Zeitschrift 61, (2000) 10, pp. 668-675.

Figure 1:
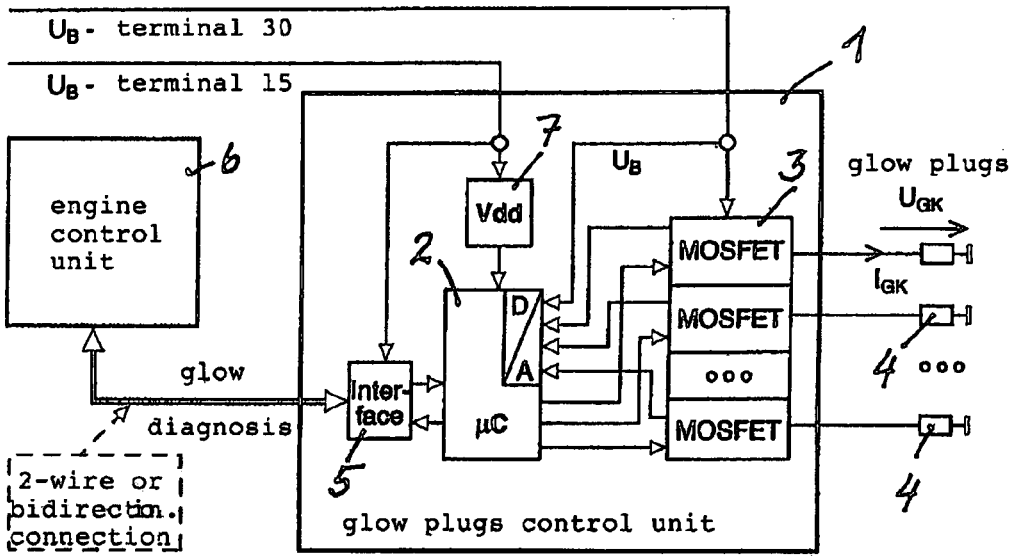

FIG. 1 shows a block diagram of a glow plug control unit 1 intended for carrying out the known method. That control unit comprises a microprocessor 2 with integrated digital-to-analog converter, a number of MOSFET power semiconductors 3 for switching on and off an identical number of glow plugs 4, an electric interface 5 for establishing connection with an engine control unit 6 and an internal voltage supply 7 for the microprocessor 2 and the interface 5. The internal power supply 7 is connected with the vehicle battery via "terminal 15" of the vehicle.

The microprocessor 2 controls the power semiconductors 3, reads their status information and communicates with the engine control unit 6 via the electric interface 5. The signals required for communication between the engine control unit 6 and the microprocessor 2 are conditioned by the interface 5. The voltage supply 7 supplies a stable voltage for the microprocessor 2 and the interface 5.

A glow plug should maintain a constant temperature (steady-state temperature), typically in the range of 1000° C., at least when the engine has reached its operating temperature. For maintaining the steady-state temperature, modern glow plugs do not require the full voltage provided by the electric system of the vehicle, but rather a voltage of typically 5 Volts to 6 Volts. The power semiconductors 3 are controlled for this purpose by the microprocessor 2 by a pulse-width modulation method with the result that the voltage provided by the vehicle's electric system, which is supplied to the power semiconductor 3 via "terminal 30" of the vehicle, is modulated so that the desired voltage is applied to the glow plugs in time average.

When the diesel engine is started in cold condition, then the control unit 1 supplies the glow plugs 1 with a higher heat-up voltage of, for example, 11 Volts so that the glow plugs will reach a temperature equal to the steady-state temperature, or—preferably—a temperature some 10° above that temperature, as quickly as possible.

Following a cold start, the engine will for some time operate in what is known as the cold-running phase, which is characterized by an idling speed above the idling speed of the engine at operating temperature. During the cold-running phase the effective voltage applied to the glow plugs, i.e. the voltage applied in time average as a result of the pulse-width modulation, is lowered by steps from the initial heat-up voltage of, for example, 11 Volts (the "initial value") to a voltage of, for example, 6 Volts at which the steady-state temperature of the glow plugs of, for example, 1000° Celsius at the operating temperature of the engine can be maintained (the "target value" of the voltage). Any variation of the voltage of the on-board electric system can be corrected by changing the on-time during pulse-width modulation.

The glow plugs will cool down to different degrees depending on the engine speed and the engine load or the engine torque. In order to still keep the glow plug temperature constant with the engine at operating temperature, the electric power applied to the glow plugs is adjusted to the varying conditions. This is done, according to signals received from the engine control unit 6, by increasing or lowering the target value of the voltage applied to the glow plugs 4 in time average.

The voltage applied to the glow plugs 4 in time average is lowered by steps in the cold-running phase during a period of time that is predefined based on empirical values stored in the microprocessor 2. The period of time during which the effective voltage is increased in the cold-running phase is maximally as long as the cold-running phase as such, preferably shorter than the latter.

Any drop in temperature of the glow plugs 4 to a temperature lower than the starting temperature, that may be observed during the cold-running phase, will lead to disturbances of the combustion process and as a result thereof to ignition failures and variations in speed that manifest themselves by especially high engine noise and an increased proportion of unburnt or incompletely burnt fuel in the exhaust gas of the engine.

It is an object of the present invention to reduce that disadvantage.

The invention achieves this object by a method having the features defined in Claim 1. Advantageous further developments of the invention are the subject-matter of the subclaims.

Instead of defining a fixed period of time in which the electric voltage is to be increased, the required period of time is defined according to the invention as the time needed until a predetermined number of revolutions of the engine has been reached. By predefining the number of revolutions as a target up to which the increase in voltage is controlled during the cold-running phase, it is ensured that the increase achieved will automatically have a duration optimized for different engine loads, depending on the load of the engine. At higher speeds, as encountered when the vehicle starts moving immediately after a cold start, uniform smooth running of the engine is reached earlier than at low engine speeds. When the engine is permitted to run through the cold-starting phase while the vehicle is stationary, a longer period of time is needed and the time during which the voltage is increased extends automatically according to the invention, compared with the case where driving is started immediately after a cold start. The preselected number of revolutions of the engine preferably is selected as a function of the engine temperature measured at the time of the cold start, the number of revolutions selected conveniently being the higher the colder the engine is at the time of the cold start. The interdependence of the number of engine revolutions and the engine temperature measured at the time of the cold start most conveniently is defined as a linear function.

As a good approximation, the engine temperature can be assumed to be constant during the entire cold-running phase. Conveniently, the temperature is measured in the coolant of the engine.

Preferably, the increase of the effective voltage during the cold-running phase of the engine is raised, during a predefined period of time, by an additional amount which varies in time and which is obtained from an empirically determined characteristic depending on the engine temperature measured at the start of the engine, which defines the additional amount of increase of the effective voltage in the course of the cold-running phase and which is formed so that the increase of the effective voltage by the additional amount will cause the difference between the effective voltage in the course of the cold-running phase and the effective voltage at the beginning of the cold-running phase to be reduced or to disappear altogether. The characteristic for a selected diesel engine may be obtained empirically, and different characteristics can be recorded for different engine starting temperatures. The number of characteristics recorded will be dependent on the accuracy desired to be achieved with respect to the constancy of the glow plug temperature during the cold-starting phase. For a temperature range of the engine starting temperature from −40° Celsius to +30° Celsius, which is of main interest in the present case, it will be sufficient to record characteristics at intervals of 5° Celsius to 10° Celsius. A closer spacing of the characteristics provides no additional essential improvement.

The described embodiment of the invention provides substantial advantages:

The combustion behavior and the idling behavior of the engine are stabilized. Idling becomes more uniform, the cold-running phase at increased idling speed can be reduced. Emissions of unburnt or incompletely burnt fuel components are reduced. The noise produced by the engine is reduced, the cold start behavior of the diesel engine is improved especially in frost.

It has been found that the additional amount, by which the increase of the effective voltage is preferably raised in the cold-running phase, is conveniently selected to be small at the beginning of the cold-running phase, to rise thereafter, to pass a maximum and to disappear at the end of the cold-running phase at the latest, preferably already before the end of the cold-running phase.

It is possible in this way to achieve a constant glow plug temperature in the cold-running phase.

Figure 2:
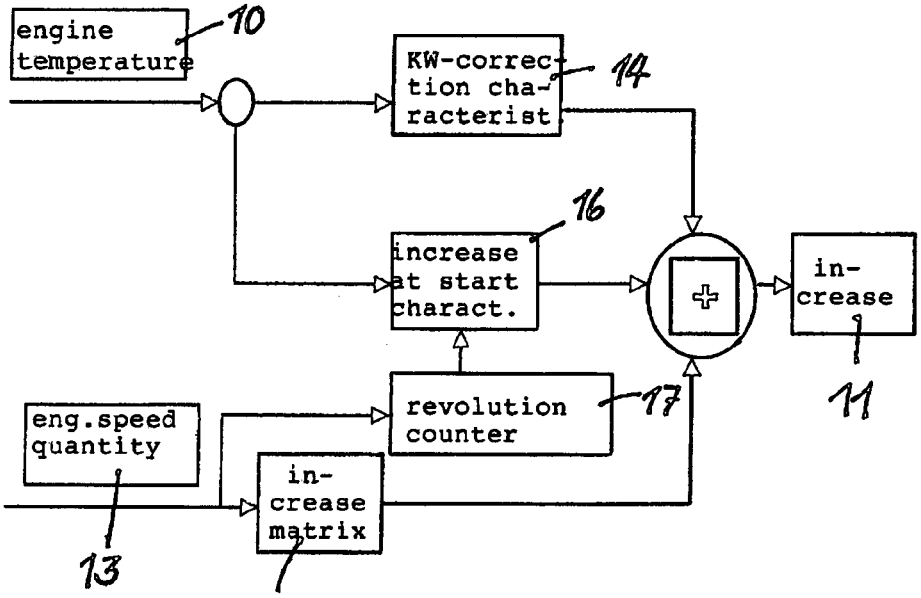

FIG. 2 shows a flow diagram for a software with the aid of which the method according to the invention can be carried out in a circuit arrangement according to FIG. 1. The software is loaded into the memory of a microprocessor 2.

The microprocessor 2 calculates an increase 11 for the effective voltage, which is applied to the glow plugs 4. The increase 11 is composed of three contributions. A first contribution is derived from an voltage increase matrix 12 stored in the microprocessor. That voltage increase matrix consists of an engine characteristics map intended to determine the effective voltage by which the glow plugs 4 are to be driven, depending on the speed of the engine and in certain cases also depending on the fuel quantity injected per time unit. These data—engine speed and injected fuel quantity (see box 13 in FIG. 2)—are transmitted as input data to the microprocessor 2 by the engine control unit 6 via the interface 5.

A second contribution 14 represents a correction to the amount derived from the voltage increase matrix 12, which depends on the measured starting temperature of the engine (see box 10). That contribution can be derived from a characteristic stored in microprocessor 2, as a function of the engine starting temperature. The starting temperature of the engine can be applied as input value to the microprocessor 2 via the interface 5 either directly from a coolant thermometer or indirectly via the engine control unit 6.

A third contribution of the increase 11 is derived from a characteristic that is obtained empirically and is stored in the microprocessor 2—see box 16. To this end, a plurality of empirically obtained characteristics for different engine starting temperatures are stored in the microprocessor 2. These characteristics contain contributions to the increase 11 of the effective voltage that vary in the course of the cold start phase, the time basis used—box 17—being not the time as such but rather the progressive number of revolutions the engine has completed from the time it was started. Accordingly, the contribution to the increase of the effective voltage, provided by the invention, is varied when the preselected number of revolutions of the engine has been reached.

The invention claimed is:

1. A method of controlling glow plugs in diesel engines by varying the effective electric voltage applied to the glow plugs between an initial value and a target value, which is obtained at the end of a cold start phase determined by an engine control unit and which is smaller than the initial value to maintain the steady-state temperature of the glow plugs, wherein the increase in voltage, the voltage difference by which the effective voltage applied to the glow plugs in the cold start phase is higher than its target value, is reduced by steps from a maximum value to zero, wherein the effective electric voltage is increased in the cold start phase of the engine over a predetermined period or time, which is determined by the time elapsed until a preselected number of revolutions of the engine is reached.

2. The method as defined in claim 1, wherein the number of revolutions is fixedly predetermined.

3. The method as defined in claim 1, wherein the preselected number of revolutions of the engine is preselected as a function of the engine temperature measured at the time of the cold start.

4. The method as defined in claim 1, wherein the preselected number of revolutions is selected to be the higher the colder the engine is at the time of the cold start.

5. The method as defined in claim 1, wherein the engine temperature is measured in the coolant.

6. The method as defined in claim 1, wherein during the cold start phase the effective electric voltage is increased by an additional amount, which is variable with time and which is derived from an empirically obtained characteristic being a function of the engine temperature measured at the time the engine is started and representing the additional amount of increase of the effective voltage during the cold start phase and which is so formed that the increase of the effective voltage by the additional amount causes the difference between the effective voltage in the cold start phase and the effective voltage at the end of the cold start phase to be reduced or to disappear altogether.

7. The method as defined in claim 1, wherein an additional amount is selected to be small at the beginning of the cold-running phase, to then rise, pass a maximum and to disappear at the end of the cold-running phase at the latest.

8. The method as defined in claim 1, wherein the increase of the effective voltage is adjusted by control signals received from the engine control unit as a function of the engine temperature and/or the engine speed or the fuel quantity injected per time unit and/or of the engine load or the engine torque, respectively.

9. The method as defined in claim 8, wherein the additional contribution to the increase in voltage is made to not depend on the fuel quantity injected per time unit.

10. The method as defined in claim 2, wherein the preselected number of revolutions of the engine is preselected as a function of the engine temperature measured at the time of the cold start.

11. The method as defined in claim 2, wherein the engine temperature is measured in the coolant.

12. The method as defined in claim 3, wherein the engine temperature is measured in the coolant.

13. The method as defined in claim 10, wherein the engine temperature is measured in the coolant.

14. The method as defined in claim 4, wherein the engine temperature is measured in the coolant.

15. The method as defined in claim 2, wherein during the cold start phase the effective electric voltage is increased by an additional amount, which is variable with time and which is derived from an empirically obtained characteristic being a function of the engine temperature measured at the time the engine is started and representing the additional amount of increase of the effective voltage during the cold start phase and which is so formed that the increase of the effective voltage by the additional amount causes the difference between the effective voltage in the cold start phase and the effective voltage at the end of the cold start phase to be reduced or to disappear altogether.

16. The method as defined in claim 3, wherein during the cold start phase the effective electric voltage is increased by an additional amount, which is variable with time and which is derived from an empirically obtained characteristic being a function of the engine temperature measured at the time the engine is started and representing the additional amount of increase of the effective voltage during the cold start phase and which is so formed that the increase of the effective voltage by the additional amount causes the difference between the effective voltage in the cold start phase and the effective voltage at the end of the cold start phase to be reduced or to disappear altogether.

17. The method as defined in claim 4, wherein during the cold start phase the effective electric voltage is increased by an additional amount, which is variable with time and which is derived from an empirically obtained characteristic being a function of the engine temperature measured at the time the engine is started and representing the additional amount of increase of the effective voltage during the cold start phase and which is so formed that the increase of the effective voltage by the additional amount causes the difference between the effective voltage in the cold start phase and the effective voltage at the end of the cold start phase to be reduced or to disappear altogether.

18. The method as defined in claim 5, wherein during the cold start phase the effective electric voltage is increased by an additional amount, which is variable with time and which is derived from an empirically obtained characteristic being a function of the engine temperature measured at the time the engine is started and representing the additional amount of increase of the effective voltage during the cold start phase and which is so formed that the increase of the effective voltage by the additional amount causes the difference between the effective voltage in the cold start phase and the effective voltage at the end of the cold start phase to be reduced or to disappear altogether.

19. The method as defined in claim 10, wherein during the cold start phase the effective electric voltage is increased by an additional amount, which is variable with time and which is derived from an empirically obtained characteristic being a function of the engine temperature measured at the time the engine is started and representing the additional amount of increase of the effective voltage during the cold start phase and which is so formed that the increase of the effective voltage by the additional amount causes the difference between the effective voltage in the cold start phase and the effective voltage at the end of the cold start phase to be reduced or to disappear altogether.

20. The method as defined in claim 11, wherein during the cold start phase the effective electric voltage is increased by an additional amount, which is variable with time and which is derived from an empirically obtained characteristic being a function of the engine temperature measured at the time the engine is started and representing the additional amount of increase of the effective voltage during the cold start phase and which is so formed that the increase of the effective voltage by the additional amount causes the difference between the effective voltage in the cold start phase and the effective voltage at the end of the cold start phase to be reduced or to disappear altogether.

* * * * *